US010377048B2

(12) United States Patent
Darwinkel et al.

(10) Patent No.: US 10,377,048 B2
(45) Date of Patent: Aug. 13, 2019

(54) ADJUSTABLE SPACING COMB, ADJUSTMENT DRIVE AND HAIR CUTTING APPLIANCE

(71) Applicant: KONINKLIJKE PHILIPS N.V., Eindhoven (NL)

(72) Inventors: Geert-Jan Darwinkel, Eindhoven (NL); Alle Braaksma, Eindhoven (NL); Cornelis Johannes Zandsteeg, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 18 days.

(21) Appl. No.: 15/511,464

(22) PCT Filed: Sep. 15, 2015

(86) PCT No.: PCT/EP2015/071027

§ 371 (c)(1),
(2) Date: Mar. 15, 2017

(87) PCT Pub. No.: WO2016/041929

PCT Pub. Date: Mar. 24, 2016

(65) Prior Publication Data

US 2017/0305020 A1 Oct. 26, 2017

(30) Foreign Application Priority Data

Sep. 18, 2014 (EP) ..... 14185364

(51) Int. Cl.

| | |
|---|---|
| ***B26B 19/20*** | (2006.01) |
| ***B26B 19/00*** | (2006.01) |
| ***B26B 19/38*** | (2006.01) |

(52) U.S. Cl.
CPC ..... *B26B 19/20* (2013.01); *B26B 19/388* (2013.01); *B26B 19/3813* (2013.01); *B26B 19/3886* (2013.01); *B26B 19/00* (2013.01)

(58) Field of Classification Search
CPC ..... B26B 19/20; B26B 19/3886; B26B 19/00; B26B 19/388; B26B 19/3813;
(Continued)

(56) References Cited

U.S. PATENT DOCUMENTS 6,968,623 B2 11/2005 Braun
7,975,387 B2 * 7/2011 Mikula ..... B26B 19/20 30/201

(Continued)

FOREIGN PATENT DOCUMENTS

CN 101722525 A 6/2010
CN 202219512 U 5/2012

(Continued)

*Primary Examiner* — Ghassem Alie

(57) ABSTRACT

An adjustment drive is provided for an adjustable spacing comb for a hair cutting appliance. The adjustment drive includes an actuator, a sensor element and a control unit. The actuator actuates a movable comb portion of the adjustable spacing comb with respect to a blade set of the hair cutting appliance. The sensor element detects multi-faceted user inputs applied to the sensor element by a user and to output a user input signal that is derived from the multi-faceted user inputs. The actuator is operated on the basis of the user input signal. The control unit is coupled to the actuator and to the sensor element, and converts the user input signal into an actuator operating signal. The multi-faceted user inputs include detected user input speed of an input stroke by the user.

16 Claims, 6 Drawing Sheets

(58) Field of Classification Search
CPC ... B26B 19/382; B26B 19/3873; B26B 19/46; B26B 19/06; A45D 26/00
USPC ..... 83/13, 522.15, 522.16, 522.19, 522.17; 30/233.5, 34.05, 45, 201, 202, 233, 216, 30/200, 41.7, 131
See application file for complete search history.

(56) References Cited

U.S. PATENT DOCUMENTS

| | | | | |
|---|---|---|---|---|
| 9,027,117 | B2 | 5/2015 | Wilairat | |
| 2008/0163495 | A1 | 7/2008 | Smal | |
| 2010/0083508 | A1 | 4/2010 | Cheng | |
| 2012/0030634 | A1* | 2/2012 | Miyazaki | G06F 3/04847 715/863 |
| 2012/0233866 | A1* | 9/2012 | Kammer | B26B 19/3853 30/201 |
| 2013/0268883 | A1* | 10/2013 | Kim | G06F 3/0485 715/784 |
| 2014/0078855 | A1* | 3/2014 | Lee | A47J 43/0716 366/142 |
| 2018/0085953 | A1* | 3/2018 | Perez Lopez | B26B 19/388 |

FOREIGN PATENT DOCUMENTS

| | | | |
|---|---|---|---|
| CN | 202747447 | U | 2/2013 |
| EP | 2218559 | A1 | 8/2010 |
| EP | 2322328 | A1 | 5/2011 |
| EP | 2500153 | A2 | 9/2012 |
| EP | 2610039 | A1 | 7/2013 |
| JP | 2000305614 | A | 11/2000 |

* cited by examiner

ADJUSTABLE SPACING COMB, ADJUSTMENT DRIVE AND HAIR CUTTING APPLIANCE

This application is the U.S. National Phase application under 35 U.S.C. § 371 of International Application No. PCT/EP2015/071027, filed on Sep. 15, 2015, which claims the benefit of International Application No. 14185364.8 filed on Sep. 18, 2014. These applications are hereby incorporated by reference herein.

FIELD OF THE INVENTION

The present disclosure relates to an adjustment drive for an adjustable spacing comb for a hair cutting appliance, wherein the adjustment drive comprises an actuator that is configured for actuating a movable comb portion of the adjustable spacing comb with respect to a blade set of the hair cutting appliance, and a drivetrain for coupling the actuator and the movable comb portion, wherein the drivetrain comprises a reduction gear unit. The present invention further relates to an adjustable spacing comb comprising such an adjustment drive and to a hair cutting appliance that comprises such an adjustable spacing comb.

BACKGROUND OF THE INVENTION

Hair cutting appliances, particularly electric hair cutting appliances, are generally known and may include trimmers, clippers and shavers. Electric hair cutting appliances may also be referred to as electrically powered hair cutting appliances. Electric hair cutting appliances may be powered by electric supply mains and/or by energy storages, such as batteries, for instance. Electric hair cutting appliances are generally used to trim (human) body hair, in particular facial hair and head hair to allow a person to have a well-groomed appearance. Frequently, electric hair cutting appliances are used for cutting animal hair.

U.S. Pat. No. 6,968,623 B2 discloses a hair trimmer comprising a body, a cutting head including a blade set, an adjustable comb, wherein the comb is movable with respect to the blade set, an electric motor for driving the blade set to effect a cutting action, and an actuator assembly that is capable of moving the comb with respect to the blade set between a fully retracted position and a fully extended position, the actuator assembly comprising a comb carriage, a comb button connected to the comb carriage, wherein the comb button is actuatable to adjust the position of the comb relative to the blade set, and a lock button movable with respect to the comb button, wherein the lock button selectively prevents and permits movement of the comb button relative to the body. Consequently, manual adjustment of the length of the comb is enabled.

EP 2 500 153 A2 discloses a hair grooming appliance comprising a housing; at least one hair grooming device carried by the housing and adapted to facilitate grooming of hair, said at least one hair grooming device comprising a blade selectively movable with respect to the housing and adapted to cut hair; an adjustable comb assembly including a comb selectively movable relative to the blade, and a comb-driving assembly operatively coupled to the comb; a control circuit in the housing and in communication with said at least one hair grooming device; and a touchscreen for receiving at least one input from a user, the touchscreen being configured to send at least one command signal to the control circuit in response to receiving said at least one input from the user, wherein the control circuit is configured to control an operation of the adjustable comb assembly, and wherein the operation of the adjustable comb assembly includes the comb-driving assembly moving the comb relative to the blade to a selected hair cut-length setting of the hair grooming appliance.

US 2008/163495 A1 discloses a hair clipper with a motorized cutting guide which comprises a motor connected by a shaft to the cutting guide. The cutting guide is driven by a program available via a microprocessor suggesting various options to the user. The user can operate the cutting guide in a manual mode and an automatic mode. The user can operate the cutting guide by pressing virtual buttons at a touchscreen.

A comb for a hair cutting appliance, particularly a spacing comb, generally may be arranged as an attachable comb or an integrally formed comb. A spacing comb generally spaces a blade set of the hair cutting appliance from the skin when the appliance is moved in a moving direction with respect to the skin during operation. Consequently, the spacing comb may enable to cut hair to a desired length, i.e. to a desired length of remaining hair at the skin.

Conventional hair cutting appliances may be fitted with a set of attachment combs, each of which associated with a distinct hair length. Consequently, a user of the appliance basically needs to replace an attachment comb by another one to alter the hair cutting length. Furthermore, manually adjustable comb attachments are known, as disclosed in U.S. Pat. No. 6,968,623 B2. Furthermore, also powered adjustment combs have been presented in recent years, as for instance disclosed in EP 2 500 153 A2. Typically, powered adjustment combs comprise a movable comb portion that is movable with respect to a blade set of the hair cutting appliance, wherein the movable comb portion is coupled to an actuator, particularly to an electromotor and/or an electric powertrain.

However, operating a motorized adjustment comb frequently has proven to be afflicted with several drawbacks. It is often cumbersome for the user to operate the adjustable spacing comb in a precise and accurate manner since typically rather conventional control elements are provided, for instance push buttons, control levers etc. Typically, these control elements provide a predefined user input sensitivity. In other words, a single user input action may cause a defined response of the motor such that the adjustable spacing comb is displaced by a defined distance or step. Basically the same applies to conventional touchscreens, as shown in EP 2 500 153 A2.

Consequently, coarsely positioning the adjustable spacing comb in the provided adjustment range (which may include covering considerably long distances in the adjustment range) may be experienced as time-consuming. Furthermore, fine adjustment of the adjustable spacing comb may be difficult since conventional control elements typically require considerably large minimum increments of the adjustment motion, as indicated above. Consequently, operating a motorized adjustable spacing comb by means of conventional control elements may be regarded as a trade-off between adjustment speed and adjustment precision.

Due to the above-mentioned lack of operating and adjusting efficiency of conventional adjustable spacing comb arrangements, operating the hair cutting appliance may be further complicated. It would be therefore advantageous to simplify the act of adjusting the spacing comb. It would be further advantageous to provide an adjustable spacing comb and an adjustment drive therefor that may be operated by the user in a time-efficient and highly accurate manner.

There is thus still room for improvement in length adjustment mechanisms.

SUMMARY OF THE INVENTION

It is an object of the present invention to provide a hair cutting appliance, an adjustable spacing comb for a hair cutting appliance, and an adjustment drive for such an adjustable spacing comb that may overcome at least some of the above-mentioned problems. In particular, it is an object to provide an adjustment drive for an adjustable spacing comb that may ensure simplified operability and, more preferably, extended input options for a user. It would be further beneficial to seek for improvements in adjustment speed and adjustment precision and accuracy. It would be further advantageous to provide a corresponding method for operating an adjustable spacing comb.

According to a first aspect of the present disclosure, an adjustment drive for an adjustable spacing comb for a hair cutting appliance is presented, the adjustment drive comprising:

an actuator that is configured for actuating a movable comb portion of the adjustable spacing comb with respect to a blade set of the hair cutting appliance, and a proximity sensitive or touch sensitive sensor element, particularly a gesture control user input interface, wherein the sensor element is configured to detect multi-faceted user inputs applied to the sensor element and to output a user input signal that is derived from the multi-faceted user inputs, and wherein the actuator is operated on the basis of the user input signal.

This aspect is based on the insight that the sensor element—which is touch sensitive sensor element which may also involve that the sensor element is arranged as a proximity sensitive sensor element—may enable user input actions which may induce both precise positioning and quick positioning of the movable comb portion. This can be achieved since the sensor element is capable of detecting multi-faceted user inputs. On the one hand side, the user may operate the sensor element slowly and by small increments (strokes). This may enable a precise positioning of the movable comb portion. On the other hand, the user may operate the sensor element quickly and by large increments (strokes). Operating the sensor element may typically comprises applying strokes or swipe movements to a sensing surface of the sensor element or, at least, in the proximity of the sensor element. Consequently, the sensor element may be configured and/or operated to detect dynamic properties and to exhibit "simulated" inertia properties. By applying quick and considerably long strokes to the sensor element, the movable comb portion may be moved by a considerably long distance. Conversely, the user may slightly and slowly drag over the sensor element so as to move the movable comb portion by considerably small increments. The sensor element may be arranged as a touch sensitive surface (touchpad) and/or a touchscreen.

As used herein, a multi-faceted user input may involve an input operation that involve more than a simple activation or deactivation (or selection or deselection). By contrast "multidimensional" user operations can be envisaged. Generally, extended information can be drawn from multi-faceted user inputs. By way of example, multi-faceted user inputs may be indicative of at least two of the following characteristics or input components: input stroke direction, input stroke speed, input stroke length, presence of input tap, presence of input stroke, presence of input double tap, presence of multi-touch operations, presence of press, presence of motion patterns, etc., and combinations thereof. Multi-faceted user inputs may also be referred to as gestures, particularly as touch gestures. In other words, more generally, multi-faceted user inputs may be referred to as multi-aspect inputs, multi-dimensional inputs, and/or multi-characteristic inputs.

As shown in the above-mentioned EP 2 500 153 A2, touchscreens may be utilized to enable simple operations such as moving a comb portion by a defined increment in response to a respective tap at a defined field of the touchscreen. Such a tap shall be referred to as simple user input and/or conventional user input. Consequently, conventional devices may, if at all, enable "one-dimensional" user operations. This may for instance require that respective fields of the touchscreen are assigned to respective simple user commands. For each user command a respective field may be required (e.g., "slow extension", "fast extension", "slow retraction", "fast retraction", etc.).

An adjustment drive in accordance with the present disclosure therefore overcomes several drawbacks inherent in conventional user operation approaches for motorized comb adjustment drives. The sensor element may provide an input surface. More particularly, at least a sub-portion of a touch sensitive layer or a proximity (sensitive) layer may be selected and/or activated for the detection of adjustment comb operation commands.

Generally, the sensor element may be referred to as length adjustment sensor element. However, the sensor element may be arranged as a multi purpose sensor element. This may involve that the sensor element is operable in several distinct operation states. Operation states may involve comb (length) adjustment, cutting speed adjustment, safety lock activation/deactivation, activation of individual stored user settings, etc.

Needless to say, the sensor element may be embedded in or covered by a housing portion of the hair cutting appliance and/or the adjustment drive. To this end, sensitive layers in accordance with touchpad and/or touchscreen techniques may be utilized that do not require contacts at the sensitive layer to detect user inputs. By way of example, the sensor element may be arranged as a touch-sensitive region at a surface of the housing portion of the hair cutting appliance. The term touch-sensitive may involve proximity sensing and/or contact sensing. Furthermore, the user may operate the sensor element with his/her fingers or thumbs. However, also input tools such as a stylus and/or similar input instruments may be utilized.

The adjustment drive in accordance with the above aspect may have the further advantage that a single sensor element may be used for extending and retracting the movable comb portion. Basically, the sensor element may detect opposite input stroke directions. Consequently, the input motion direction may be "translated" into an extending or a retracting motion of the movable comb portion.

Depending on a detected input speed level, respective operation modes may be selected (in terms of retraction/extraction speed, retraction/extraction increments and/or retraction/extraction motion overrun or time lag). Consequently, a relatively fast user input stroke may trigger an operation mode wherein an inertia behavior of the sensor element is simulated by activation a motion overrun or time lag which may include the an adjustment motion in response to the user input stroke is present for a longer period than the initial input stroke.

According to an embodiment of the adjustment drive, the user input signal is indicative of at least one signal component selected from the group consisting of input speed, input direction, input drag length, input path length, and combinations thereof. Consequently, enhanced user input information can be derived from an input action applied to the sensor element. A detected input direction can indicate whether an extraction or a retraction of the movable comb portion is desired. A detected input drag (or stroke) length can indicate a desired absolute or relative length adjustment level in a qualitative and/or quantitative manner.

The signal components may also be referred to as signal characteristics. Preferably, the user input signal is indicative of at least two signal components selected from the group consisting of input speed, input direction, input drag length, input path length, and combinations thereof. Input speed detection may comprise the detection of peak velocities and/or average velocities of a user input stroke or drag while performing a gesture. Input speed detection may be based on the detection of a time interval that is actually required for accomplishing a user input, particularly a user input gesture, or a least a portion thereof. Input direction detection may comprise rough detection of instantaneous and/or overall directions of a user input stroke or drag while performing a gesture. Rough detection of directions may involve assigning detected inputs to defined main input directions (e.g., ±X, ±Y, North <>

South, East <> West, etc.). Generally, direction detection may also involve the detection of a positive/negative sign of a user input stroke or drag. Furthermore, also more precise direction detection of user input strokes or drags may be envisaged.

In another embodiment, the adjustment drive further comprises a control unit coupled to the actuator and to the sensor element, wherein the control unit is configured to convert the user input signal into an actuator operating signal. The above embodiment of the adjustment drive can be further developed in that the control unit is further configured to set an adjustment length value based on a detected user input speed, and wherein the control unit is preferably further configured to set an adjustment direction based on a detected user input direction.

As already mentioned above, the user input signal can be indicative of at least one value selected from the group consisting of input command speed, input command direction and input command length, particularly of input stroke speed, input stroke direction, input stroke length, and combinations thereof. Generally, the actuator operating signal may be indicative of at least one value selected from the group consisting of adjustment direction, relative adjustment length, absolute adjustment length, relative adjustment offset, absolute adjustment offset, adjustment speed, adjustment time, and combinations thereof.

In yet another embodiment of the adjustment drive, the control unit is further configured to adjust length adjustment increments depending of detected user input speed, wherein the actuator is operated on the basis of a set length adjustment increment. Consequently, the adjustment drive may be operable at a plurality of adjustment speed ranges which may also be referred to as adjustment "gear" ranges. However, the adjustment "gear" ranges shall not be interpreted in a limiting sense as necessarily referring to fixed (mechanical) gear ranges. Rather, speed control and speed adjustment may be based on a variation of the voltage on the actuator (or: motor) of the adjustment drive, for instance. Hence, a virtual gear setting may be utilized (based on respective voltage ranges). Further, the adjustment speed may be basically infinitely (or: steplessly) adjustable by respective voltage variation. This may involve that the adjustment speed may be varied in small increments so that actually small adjustment steps may be present.

In one exemplary configuration, the adjustment drive can be operated in a rough adjustment mode and a fine adjustment mode, depending on a detected input speed. The rough adjustment mode may comprise incremental step size responses to a single user input event in the range from about 0.5 mm to about 5 mm, the applied value depending on a detected input length. The fine adjustment mode may comprise incremental step size responses to a single user input event in the range from about 0.1 mm to about 0. 5mm, the applied value depending on a detected input length. More generally, at least a first and a second distinct operation mode may be selected on the basis of at least one value that can be derived from the detected enriched user input information.

In still another embodiment of the adjustment drive, the control unit is further configured to convert a slow user input motion into a small length adjustment increment, and wherein the control unit is further configured to convert a fast user input motion into a large length adjustment increment. Preferably, the control unit is further configured to convert a small user input motion length into a small absolute length adjustment motion. More preferably, the control unit is further configured to convert a large user input motion length into large absolute length adjustment motion.

Consequently, the control unit is operable to either "amplify" (or gear up) detected user inputs into a large comb adjustment response or to "gear down" detected user inputs into a small comb adjustment response. Consequently, slow user input movement may result in precise incremental step output while fast user input movement may result in fast output at relatively large increments.

Generally, the present disclosure makes use of the idea that the activation impulse applied by the user to the sensor element and a corresponding data processing activity carried out by the control unit can be (physically) decoupled from each other such that a respective operation mode detection algorithm may be interposed between the user input impulse and the determination of the corresponding actuator operation signal. In other words, the operation mode detection algorithm can detect or, rather, anticipate whether fast response or slow response is desired by the user. This may further result in a quickly moving movable comb portion towards longer (absolute and/or relative) length settings, and a slowly and precisely moving movable comb portion in a shorter (absolute and/or relative) length setting range.

In still yet another embodiment of the adjustment drive the sensor element is configured to detect touch gestures and/or gestures in the proximity of the sensor element. Preferably, the sensor element is preferably configured to detect a user input swipe. User input gestures may generally comprise swipe, pinch, zoom and tap input actions. As used herein an input swipe may also be referred to as an input stroke. An input swipe may be induced by a uses by dragging a finger (or thumb) across a touch-sensitive or proximity-sensitive surface of the sensor element.

In another preferred embodiment of the adjustment drive, the sensor element comprises a touch-sensitive surface including (or being coupled to) at least one tactile sensor. The touch-sensitive surface may be formed by at least one flexible foil, particularly a conductive or capacitive flexible foil. The touch-sensitive surface may be formed by or be coupled with a flexible printed circuit board, for instance. The sensor element may be arranged as a touchpad, a trackpad, a touchscreen and/or similar gesture-sensitive input interfaces, preferably contact and/or proximity sensitive input interfaces.

It is worth mentioning in this regard that in some embodiments a flexible printed circuit board may be utilized that may be arranged as a capacitive and/or inductive sensor capable of detecting changes in capacity and/or inductivity. In some specific embodiments, the capacitive and/or inductive sensor may be arranged remote from the touch-sensitive surface. In other words, a respective sensor may be arranged within the housing of the hair cutting appliance. To this end, at least one signal transmission element may be disposed between the (inner) sensor and the (outer) touch-sensitive surface. The at least one signal transmission element may be arranged as a metal transmitter, for instance a metal spring that connects the (inner) sensor and the (outer) touch-sensitive surface. The metal spring-based signal transmission element may further comprise a metal plate that is coupled to the touch-sensitive surface.

At the touch-sensitive surface, capacitive and/or inductive manipulations can be applied by the user when performing an input operation. Respective signals that are indicative of the input operation can be "transferred" to the (inner) sensor. Preferably, at least two signal transmission elements may be utilized. More preferable, at least three signal transmission elements may be arranged at separate locations at the touch-sensitive surface. As a consequence of the arrangement of multiple signal transmission elements, multi-directional user inputs can be detected. Preferably, each signal transmission element is assigned to a respective sensor element of the sensor.

In accordance with still another embodiment of the adjustment drive, the sensor element is a capacitive sensing element or a conductance sensing element, and wherein the sensor element is preferably a multi-touch sensing element. Capacitive touch sensing elements and conductance touch sensing elements are generally known to the person skilled in the art, particularly in connection with mobile devices and/or computer technology interfaces. Furthermore, so-called multi touch sensor elements are generally known to the person skilled in the art. However, adopting these techniques shall not be understood as potentially rendering the present disclose obvious.

In yet another embodiment, the adjustment drive further comprises a feedback unit that is operably coupled to the control unit. Preferably, the control unit is configured to provide user guidance indicating that user inputs are enabled at the sensor element. Preferably, the control unit is further configured to provide user feedback in response to detected user inputs to the user. Generally, the sensor element and the feedback unit may be integrally implemented in a touchscreen unit. However, also alternative embodiments including a sensor element and a feedback unit that are separately arranged in a distinct manner may be envisaged. User feedback may generally comprise an indication of an actual and/or a selected length of the movable comb.

The above embodiment may be further developed in the feedback unit comprises at least one of an optical feedback element, an acoustic feedback element and/or a tactile feedback element. A tactile feedback element may be arranged as part of a haptic response system and include vibration elements, for instance. An optical feedback element may be arranged as a light feedback element, such as an LED. Also a touchscreen may be operated so as to define at least one optical feedback element.

Particular in connection with optical feedback elements, visual guidance for the user can be provided to indicate where and how a comb length adjustment input can be applied to the sensor element. In may be further preferred in this context, that the feedback unit comprises an array of optical feedback elements, particularly an array of chase light elements that are selectively operable to indicate a direction of potential user inputs. Chasing lights may indicate both input direction and a location or region where user inputs may be applied.

According to another aspect of the present disclosure, an adjustable spacing comb for a hair cutting appliance is presented, the adjustable spacing comb comprising a movable comb portion that is arranged to be moved with respect to a housing portion of the hair cutting appliance, and an adjustment drive in accordance with at least some embodiments discussed herein. In other words, the movable comb portion is movable with respect to the housing portion of the hair cutting appliance. Generally, the spacing comb may be arranged as an attachable and detachable spacing comb. In the alternative, the spacing comb may be arranged as an integrated or integrally provided spacing comb that cannot be detached from the hair cutting appliance. The movable comb portion may comprise a plurality of comb teeth that may divide and guide hairs when the hair cutting appliance including the adjustable spacing comb is moved through hair to cut hair to a selected length.

In yet another aspect of the present disclosure, a hair cutting appliance, particularly a hair trimmer or clipper, is presented, the hair cutting appliance comprising a housing portion, a cutting unit including a blade set, and an adjustable spacing comb in accordance with at least some embodiments described herein. Generally, the hair cutting appliance may be regarded as an electrically powered hair cutting appliance. Consequently, a motor may be provided for driving the blade set. Typically, the blade set may comprise a stationary blade and a movable blade, wherein the movable blade is movable with respect to the stationary blade. The movable blade may be driven with respect to the stationary blade, particularly oscillatingly driven. The movable blade and the respective stationary blade may comprise cutting edges that may cooperate to cut hair.

Generally, the hair cutting appliance may comprise an elongated housing comprising a first end and a second end which is opposite to the first end. At the first end of the housing, a cutting head may be arranged. The second end of the housing may also be referred to as handle end.

In one embodiment of the hair cutting appliance, the sensor element is inconspicuously integrated in the housing portion. This may involve that the sensor element is hidden in the housing portion. Preferably, the sensor element, particularly a touch-sensitive or proximity-sensitive foil thereof, is covered by a wall of the housing portion. This may be advantageous since in this way an integrally shaped housing portion may be provided that exhibits a reduced tendency for soiling and dirt deposits. Furthermore, forming the device in a waterproof-manner can be facilitated. However, as indicated above, alternatively or in addition, the hair cutting appliance may be fitted with a touchscreen that may be utilized for the detection of multi-faceted user inputs and, at least in some embodiments, for providing user feedback, particularly user guidance.

According to yet another aspect of the present disclosure, a method for operating an adjustable spacing comb for a hair cutting appliance is presented, the method comprising the following steps:

providing an adjustment drive comprising an actuator for actuating a movable comb portion of the adjustable spacing comb, providing a proximity sensitive or touch sensitive sensor element, particularly a gesture control user input interface, detecting multi-faceted user inputs applied to the sensor element, outputting a user input signal that is derived from the detected multi-faceted user inputs, and operating the actuator on the basis of the user input signal.

Preferably, the method can make use of the adjustable spacing comb and the adjustment drive as discussed herein. Preferred embodiments of the disclosure are defined in the dependent claims. It shall be understood that the claimed method has similar and/or identical preferred embodiments as the claimed device and as defined in the dependent claims.

BRIEF DESCRIPTION OF THE DRAWINGS

These and other aspects of the disclosure will be apparent from and elucidated with reference to the embodiments described hereinafter. In the following drawings

DETAILED DESCRIPTION OF EMBODIMENTS

Figure 1:
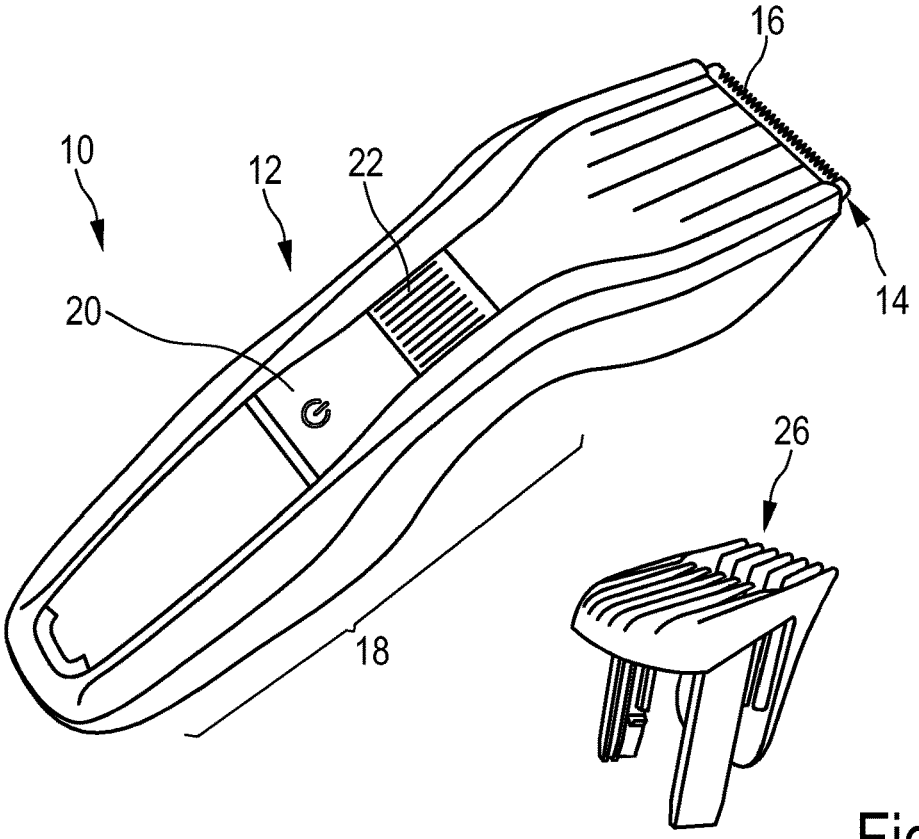
FIG. 1 shows a schematic perspective view of an exemplary embodiment of an electric hair cutting appliance and an adjustable spacing comb, wherein the spacing comb is shown in a detached state.

FIG. 1 shows a schematic perspective view of a hair cutting appliance 10, particularly an electrically-operated hair cutting appliance 10. The hair cutting appliance 10 may also be referred to as hair clipper or hair trimmer. The hair cutting appliance 10 may comprise a housing or housing portion 12 having a generally elongated shape. At a first end thereof, a cutting unit 14 may be provided. The cutting unit 14 may comprise a blade set 16. The blade set 16 may comprise a movable blade and a stationary blade that may be moved with respect to each other to cut hair. At a second end of the housing portion 12, a handle or grip portion 18 may be provided. A user may grasp or grab the housing at the grip portion 18.

The hair cutting appliance 10 may further comprise operator controls. For instance, an on-off switch or button 20 may be provided. Furthermore, a length adjustment control 22 may be provided at the housing 12 of the hair cutting appliance 10. The length adjustment control 22 may be provided in case an adjustable spacing comb 26 is attached to the housing portion 12 of the hair cutting appliance 10. In FIG. 1, the adjustable spacing comb 26 is shown in a detached or released state. When the spacing comb 26 is detached from the hair cutting appliance 10, a minimum cutting length may be achieved. When the spacing comb 26 is attached to the hair cutting appliance 10, hairs can be cut to a desired length.

Figure 2:
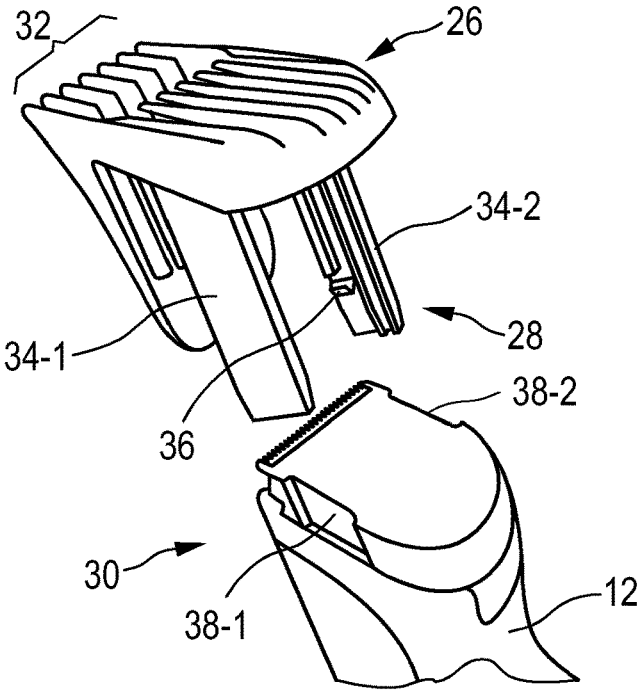
FIG. 2 shows a partial exploded view of yet another embodiment of a hair cutting appliance and an adjustable spacing comb, wherein the spacing comb is shown in an insertion orientation.

FIG. 2 shows a partial perspective schematic illustration of a first end of a housing portion 12 of a hair cutting appliance 10. Furthermore, an adjustable spacing comb 26 is shown in an insertion orientation with respect to the housing portion 12. The housing portion 12 and the adjustable spacing comb 26 are shown in an exploded state. By way of example, the spacing comb 26 may comprise an attachment portion 28 which may comprise, for instance, sliding beams 34-1, 34-2. The attachment portion 28 may engage the housing portion 12. More particularly, the attachment portion 28 may be attached to a mounting portion 30 of the housing portion 12. To this end, the sliding beams 34-1, 34-2 may be inserted into respective mounting slots 38-1, 38-2 at the mounting portion 30. The attachment portion 28 may further comprise at least one snap-on member 36 which may be provided at at least one of the sliding beams 34-1, 34-2, for instance. The snap-on member 36 may secure the spacing comb 26 in its mounted state.

As can be further seen from FIG. 2, the spacing com 26 may further comprise a toothed portion 32 including a plurality of comb teeth. Generally, the toothed portion 32 may comprise a slot in which the blade set 16 can be arranged in the attached state.

Figure 3:
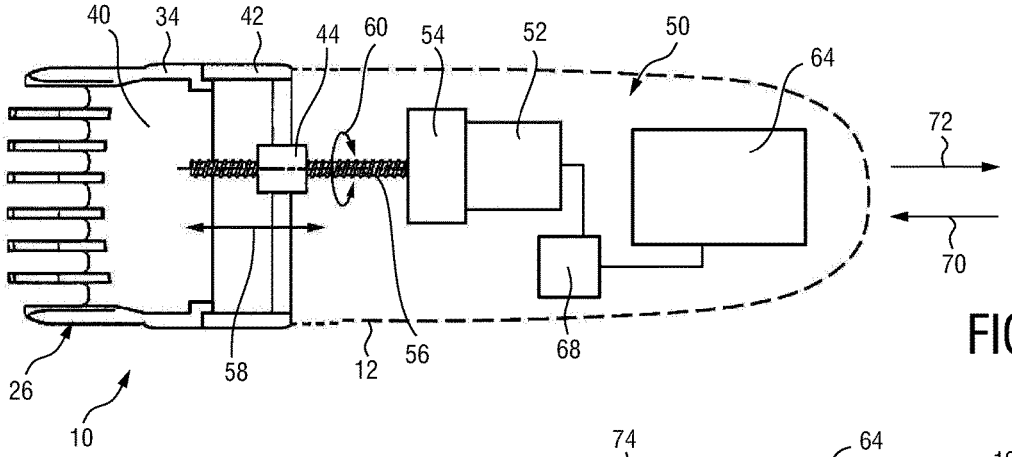
FIG. 3 shows a simplified top view of an exemplary embodiment of a hair cutting appliance fitted with an adjustable spacing comb and an adjustment drive for the spacing comb.
Figure 4:
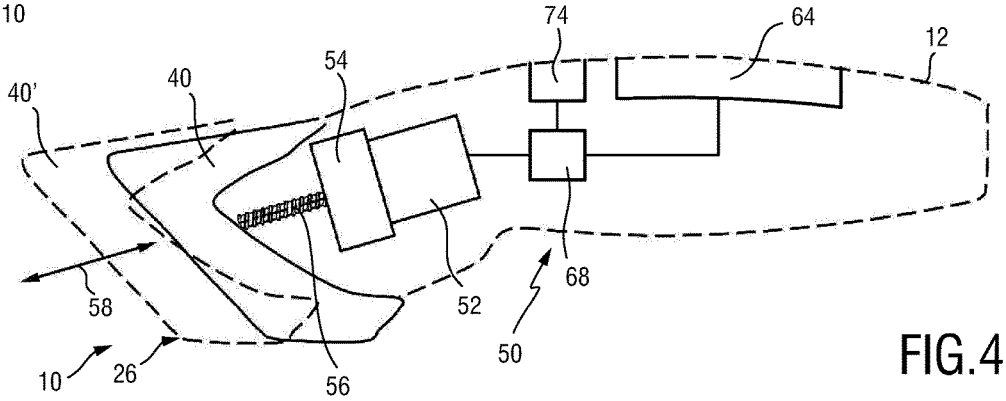
FIG. 4 shows a schematic simplified side view of an exemplary embodiment of a hair cutting appliance fitted with a retractable spacing comb and an adjustment drive for adjusting the spacing comb.

With further reference to FIG. 3 and FIG. 4, an exemplary embodiment of an adjustable spacing comb 26 and an embodiment of an exemplary adjustment drive 50 for operating the spacing comb 26 are further illustrated and described. FIG. 3 shows a schematic back view of a hair cutting appliance 10. FIG. 4 shows a schematic side view of a hair cutting appliance 10. It is worth mentioning in this regard that the views shown in FIG. 3 and FIG. 4 do not necessarily represent the same arrangement or embodiment. Respective housing portions 12 of the hair cutting appliance 10 are indicated in FIG. 3 and FIG. 4 by dashed lines. Consequently, internal components of the hair cutting appliance 10 are visible.

With particular reference to FIG. 3, the adjustable spacing comb 26 is further described. The adjustable spacing comb 26, refer also to FIG. 1 and FIG. 2, may comprise sliding beams 34 that may cooperate with a carriage 42 that is arranged at the housing 12. Generally, a snap-on mounting of the sliding beams 34 at the carriage 42 may be provided. At least a substantial portion of the spacing comb 26 may be regarded as movable comb portion 40. As can be best seen in FIG. 3, the movable comb portion 40 may be coupled to the carriage 42 and consequently moved along with the carriage 42. For driving the carriage 42 and the movable comb portion 40, an engagement member 44 may be provided that is coupled to the carriage 42. For operating or driving the movable comb portion 40 with respect to the blade set 16 (refer to FIG. 1), an adjustment drive 50 may be provided which may also be referred to as adjustment powertrain. In other words, the adjustment drive 50 may be regarded as motorized adjustment drive 50.

The adjustment drive 50 may comprise an actuator 52 or, more particularly, an electromotor. The actuator 52 may be coupled to a reduction gear 54. The reduction gear 54 may be coupled to a transmission element 56. Generally, the transmission element 56 may be arranged to convert a rotational output motion of the actuator 52 and the reduction gear 54, if any, into a basically longitudinal positioning motion of the movable comb portion 40. A respective longitudinal direction is indicated in FIG. 3 and FIG. 4 by a double arrow denoted by reference numeral 58.

As can be seen from FIGS. 3 and 4, the transmission element 56 may be arranged as threaded spindle, particularly a small pitch spindle. Consequently, the transmission element 56 may be arranged to be set into rotational movements, refer to the curved arrow denoted by reference numeral 60 in FIG. 3. The transmission element 56 may be configured to engage the engagement member 44 so as to push or pull the carriage 42 and, consequently, the movable comb portion 40. In some embodiments, the transmission element 56 may be arranged as gear rack element. In some embodiments, the transmission element 56 may be arranged as push rod element. Generally, the actuator 52 may be mechanically connected to the carriage 42 and, in the mounted state, to the movable comb portion 40.

For operating the adjustment drive 50, respective control elements may be provided. To this end, the adjustment drive 50 may comprise a sensor element 64, particularly a sensor element 64 that is sensitive to user gestures. The sensor element 64 may be arranged as a touch-sensitive and/or a proximity-sensitive sensor element 64. The sensor element 64 may be arranged as a basically areally extending sensor element 64, e.g. a sensor element 64 extending in basically two dimensions. Needles to say, the sensor element 64 may include a curved surface. In accordance with the present invention, the sensor element 64 is configured to detect relatively multi-faceted user inputs that are indicative of extended or enhance user input information. By way of example, user inputs may comprise input swipes, e.g. user strokes across the sensor element 64.

The sensor element 64 may be coupled with a control unit 68. The control unit 68 may be provided with a user input signal that is delivered from the sensor element 64. The control unit 68 may monitor the sensor element 64. The control unit 68 may comprise a processing unit. The control unit 68 may convert the detected user input signal into an actuator operating signal that may be transferred to the actuator 52. Consequently, there is no power transmission or force transmission link between the actuator 52 and the sensor element 64. Rather, electric signals may be transferred from the sensor element 64 to the actuator 52 via the control unit 68. As indicated above, the user input signal may be indicative of extended information, such as input speed, input length, input direction and respective information derivable therefrom. Based on the extended information, the control unit 68 may process a resulting actuator operating signal that can be used to operate the actuator 52.

As illustrated in FIG. 3 by arrows 70, 72 indicating opposite directions, the control unit 68 may be configured to derive a user input direction from the user input signal. As a result, the control unit 68 may operate the actuator so as to either extend or retract the movable comb portion 40, depending on the user input detected direction 70, 72. Consequently, multiple functions may be assigned to a single sensor element 64. There is no absolute need to separately set a particular operation mode at the sensor element 64 since the user may apply multi-faceted user inputs (gestures). Alongside the detection of the user input direction 70, 72, the control unit 68 may derive a desired length adjustment value from the user input signal. The length adjustment value may be derived from the input (stroke) speed and/or the input (stroke) length sensed by the sensor element 64. Consequently, the control unit 68 may operator the actuator accordingly so as to induce a desired length adjustment action.

Further reference is made to FIG. 4. An extracted state of the movable comb portion 40' is indicated in FIG. 4 by a respective dashed line. As illustrated in FIG. 4, the adjustment drive 50 may further comprise a feedback unit 74 that is capable of providing feedback to user inputs and/or user feedback to the user. Generally, the feedback unit 74 may be arranged as an optical feedback unit, a tactile feedback unit, an acoustic feedback unit, and combinations thereof. The feedback unit 74 and the sensor element 64 may be arranged at spaced apart locations at the hair cutting appliance 10, particularly at the housing portion 12 thereof. However, at least in some embodiments, the feedback unit 74 and the sensor element 64 arranged at the same region of the hair cutting appliance 10, particularly at the housing portion 12 thereof. The feedback unit 74 and the sensor element 64 may at least partially overlap each other. The feedback unit 74 and the sensor element 64 may be integrally formed as a combined input/feedback interface, such as a touchscreen.

Figure 5:
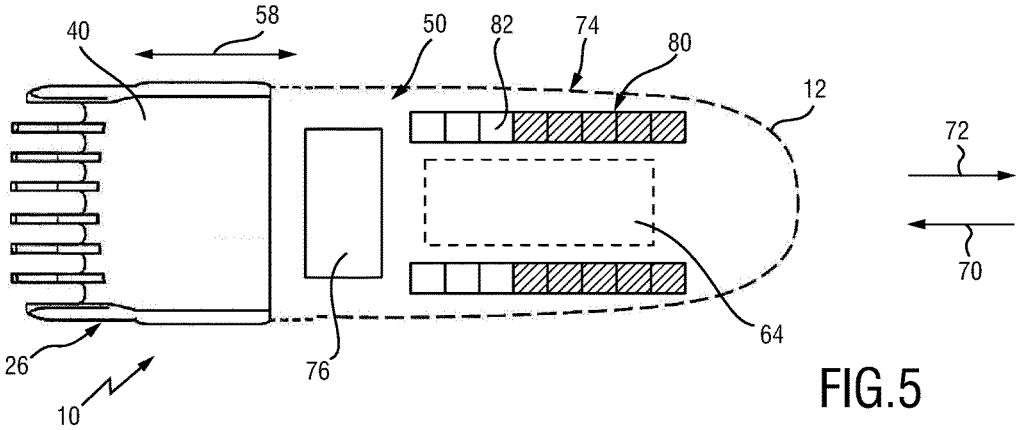
FIG. 5 shows a simplified top view of another exemplary embodiment of a hair cutting appliance fitted with an adjustable spacing comb and an adjustment drive for the spacing comb, the appliance comprising an exemplary user input layout.
Figure 6:
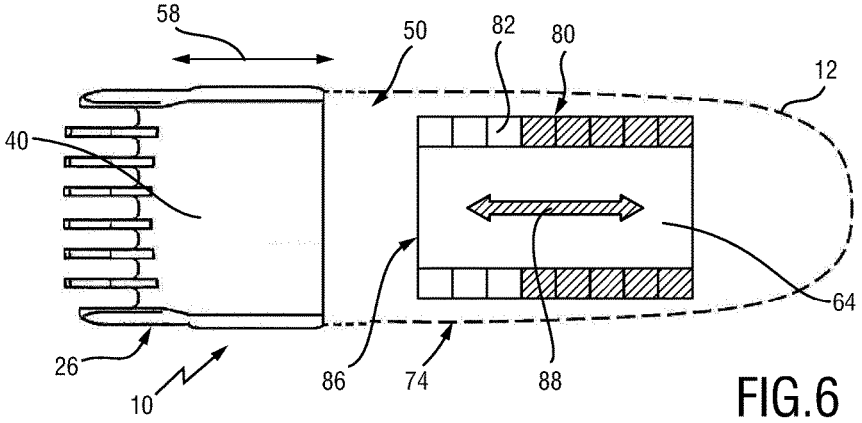
FIG. 6 shows a simplified top view of another exemplary embodiment of a hair cutting appliance fitted with an adjustable spacing comb and an adjustment drive for the spacing comb, the appliance comprising another exemplary user input layout.

Further reference is made to FIG. 5 and to FIG. 6. FIGS. 5 and 6 illustrate exemplary embodiments of an adjustment drive 50 in accordance with the present disclosure, wherein varying configurations of respective feedback units 74 are illustrated. As illustrated in FIG. 5, the feedback unit 74 may comprise a display 76, particularly an LCD or an LED display 76. Generally, the display 76 may be arranged to provide visual feedback and/or user guidance to the user. The display 76 may be arranged to display graphics and/or alphanumeric information. The display 76 may be arranged as a multi-purpose display that is also capable of illustrating information that is not related to the adjustment comb length setting. For instance, the display 76 may be arranged to display a state of charge of a battery of the hair cutting appliance 10 and or a selected hair cutting operation mode.

With respect to the adjustment comb length setting, the display 76 may be arranged to illustrate alphanumeric comb length related information. Furthermore, display 76 may display user guidance information indication that the user may select a desired length setting by applying a multi-faceted user input to the sensor element 64. As can be further seen from FIG. 5, feedback unit 74 may also comprise at least one array 80 of visual feedback elements 82 which may also referred to as optical feedback elements 82. Generally, the feedback elements 82 may be arranged as light emitting feedback element, such as a light emitting diode (LED). Preferably, the array 80 may be arranged as a chasing light array 80. As shown in FIG. 5, two arrays 80 may be arranged at the housing 12 of the hair cutting appliance. For instance, the arrays 80 of feedback elements 82 may be arranged at opposite (lateral) ends of the sensor element 64 (indicated in FIG. 5 by dashed lines). The arrays 80 of feedback elements 82 may be arranged adjacent to a region in which the sensor element 64 extends.

This arrangement may have the advantage that the chasing light arrays 80 may clearly indicate that the user may adjust the comb length by dragging across the sensor element 64 in the desired direction (arrows 70, 72) to extend or retract the movable comb portion 40. Each of the feedback elements 82 may be selectively activated or deactivated. Further, feedback elements 82 may be operated in a chasing light manner so as to clearly indicate the directions 70, 72. However, the feedback elements 82 may be also operated so as to indicate absolute and/or relative length adjustment settings, such as absolute and/or relative length adjustment values.

As can be seen from FIG. 6, the feedback unit 74 may further comprise an integrated touchscreen 86 that is capable of both sensing user inputs and providing user feedback in response to the input and/or providing user guidance in connection with the user inputs. In FIGS. 5 and 6 exemplarily activated feedback elements 82 are shown in a hatched state. Generally, the touchscreen 86 may be arranged to display graphics and/or alphanumeric information. This may involve that "simulated" chasing light arrays 80 including a plurality of feedback elements 82 may be shown by the touchscreen 86. Further, a prominent user guidance element 88 may be displayed at the touchscreen 86 to indicate that the user may directly apply user inputs at the sensor element 64 that is arranged as a part of or associated with the touchscreen 86. The user guidance element 88 may be shown in addition or in the alternative to the chasing light arrays 80.

Figure 7:
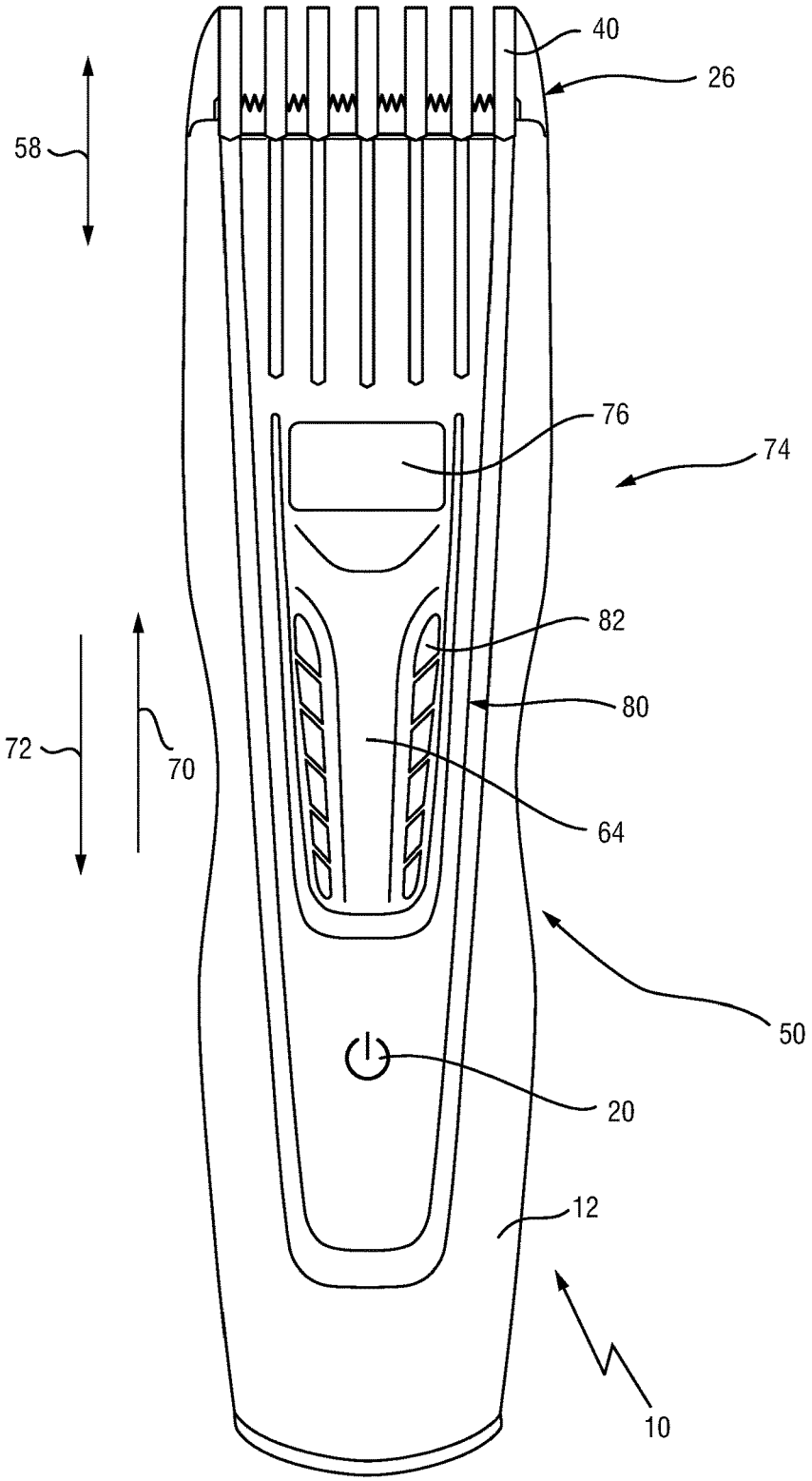
FIG. 7 shows a top view of another exemplary embodiment of a hair cutting appliance fitted with an adjustable spacing comb and an adjustment drive for the spacing comb, the appliance comprising yet another exemplary user input layout.

FIG. 7 illustrates a top view of another exemplary embodiment of a hair cutting appliance 10 that is fitted with an adjustable spacing comb 26 and an adjustment drive 50 for the spacing comb 26, wherein the adjustment drive 50 comprises yet another exemplary user input layout. A sensor element 64 is provided that is arranged in a central region of the housing portion 12. With respect to user feedback, the sensor element 64 may be basically passive. The sensor element 64 may comprise a touch-sensitive surface that is arranged between two arrays 80 of visual (optical) feedback elements 82. Consequently, the arrays 80 may be operated as chasing light arrays to indicate the location of the sensor element 64 and the respective surface where user inputs may be applied, e.g. by dragging across the sensor element 64. Furthermore, a display 74 may be provided that is capable of presenting graphics and/or alphanumeric information.

In some embodiments, the sensor element 64 may be further coupled with a feedback unit that is capable of providing tactile feedback (not shown in FIG. 7). To this end, respective vibrating elements may be provided in the vicinity of the sensor element 64.

Figure 8:
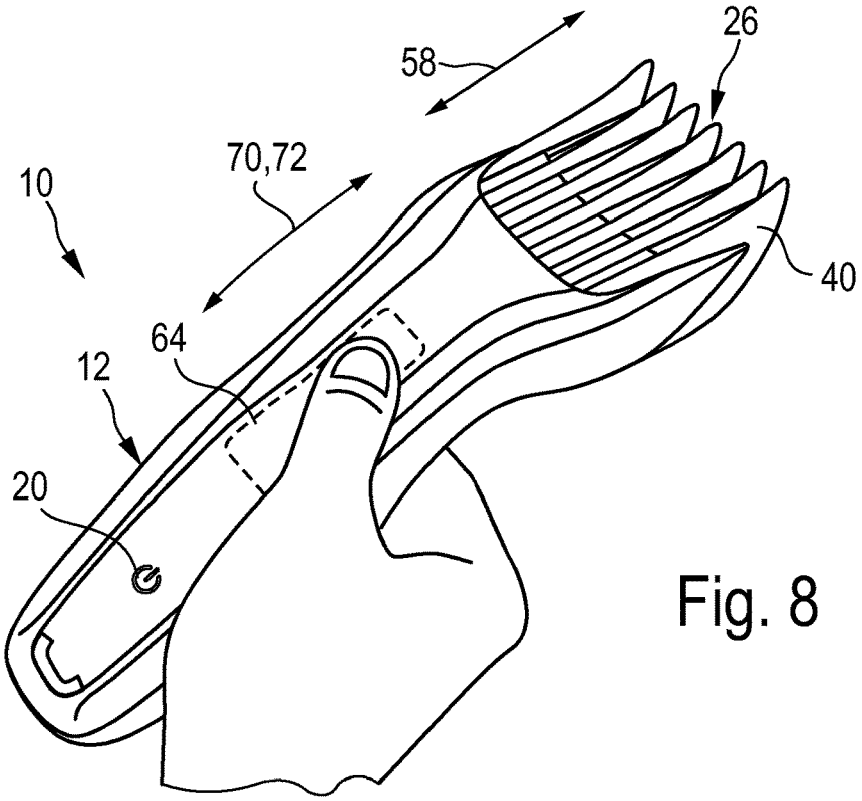
FIG. 8 is a schematic perspective view of an exemplary hair cutting appliance fitted with an adjustable spacing comb, the hair cutting appliance being held by a user that may operate a sensor element for operating an adjustment drive for the spacing comb.
Figure 9:
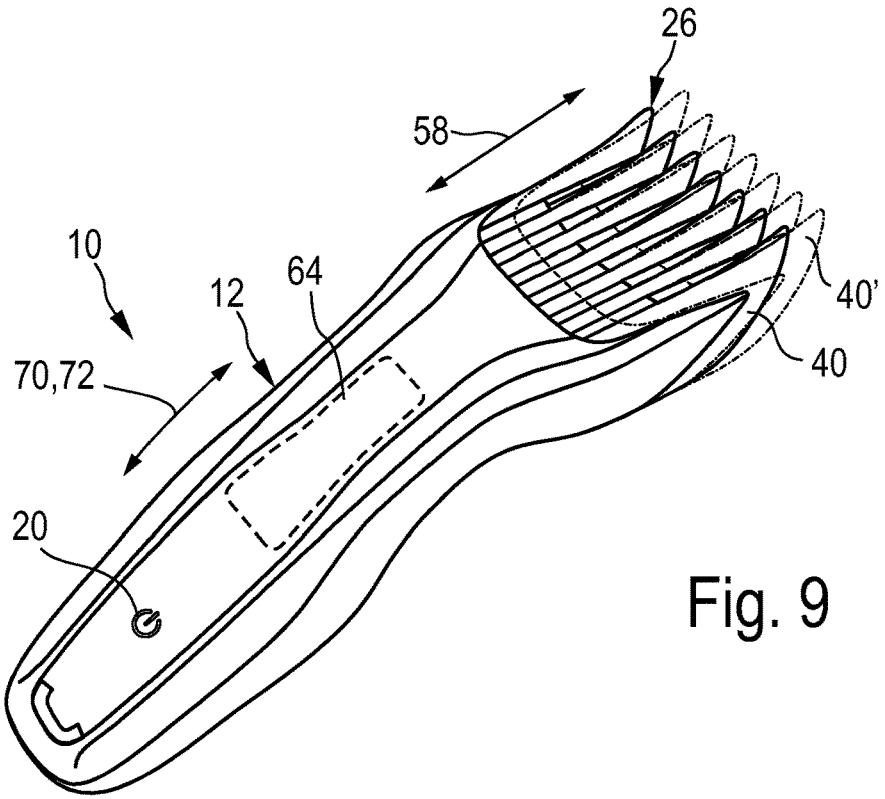
FIG. 9 is a schematic perspective view of the hair cutting appliance illustrated in FIG. 8, wherein the user's hand is not shown and wherein an extended state of the adjustable spacing comb is illustrated by dashed lines.

With further reference to FIG. 8 and FIG. 9, exemplary embodiments of the hair cutting appliances 10 are illustrated that are fitted with a respective adjustable spacing comb 26. FIG. 8 shows a perspective view of hair cutting appliances 10 in a state held by a user. The hair cutting appliances 10 may further comprise an adjustment drive for the adjustable spacing comb 26 (not shown in FIG. 3 and FIG. 4). The user may actuate the adjustment drive by operating sensor element 64, particularly by applying gestures (swipes, strokes, etc.) to a touch-sensitive and/or proximity sensitive surface. Generally, the adjustable spacing comb 26 or, more particularly, a movable comb portion 40 (refer to FIG. 9) thereof may be moved with respect to the blade set 16 of the hair cutting appliance 10 (refer to FIG. 1) to adjust a distance between the adjustable spacing comb 26 and the blade set 16. By way of example, the movable spacing comb 26 may be extracted or retracted in a generally longitudinal direction indicated in FIG. 3 and FIG. 9 by a double-arrow denoted by reference numeral 58.

The spacing comb 26 shown in FIG. 8 is in a retracted state. FIG. 9 illustrates a retracted and an extracted state of the movable comb portion 40 of the spacing comb 26. A respective extracted state of the movable comb portion 40' is indicated in FIG. 9 by dashed lines. As can be seen in FIG. 8, the user may actuate the sensor element 64 in a basically longitudinal direction 70, 72 to cause an adjustment movement of the spacing comb 26. By actuating or operating the sensor element 64, the user may control the adjustment drive for the adjustable spacing comb 26 so as to define or set a desired cutting length.

It goes without saying that the exemplary configurations of the adjustment drive 50 illustrated in FIGS. 3 to 9, particularly of the sensor elements 64 and the feedback units 74 thereof, are primarily provided for the sake of illustration. Consequently, the respective embodiments shall not be understood in a limiting sense.

Figure 10:
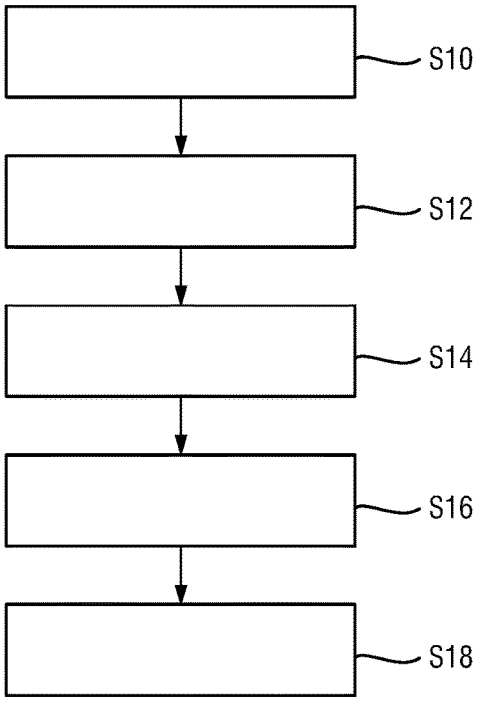
FIG. 10 shows an illustrative block diagram representing several steps of an embodiment of an exemplary method for operating an adjustable spacing comb for a hair cutting appliance in accordance with several aspects of the present disclosure.

With further reference to FIG. 10, an exemplary method of operating an adjustable spacing comb for a hair cutting appliance is illustrated and further described. The method may comprise a step S10 which may involve providing an adjustment drive that comprises an actuator for actuating a movable comb portion of an adjustable spacing comb of a hair cutting appliance. Preferably, the adjustment drive is shaped in accordance with at least some embodiments as disclosed herein. A further step S12 may follow which may involve providing sensor element. The sensor element may be arranged as a proximity sensitive or touch sensitive, particularly a gesture control user input interface. A further step S14 may follow which may involve the detection of multi-faceted user inputs applied to the sensor element. Multi-faceted user inputs may involve strokes, gestures, etc. In a subsequent step S16, based on the detected user inputs, a respective user input signal may be generated and provided for further processing. Preferably, the user input signal is at least indicative of input speed. Further, the user input signal may be indicative of input direction, input length and further input values that are derivable therefrom. At still another step S18, the actuator of the adjustment drive may be operated on the basis of the user input signal. The step S18 may involve the conversion of the user input signal into an actuator operating signal. To this end, a control unit may be provided. In case the user input basically consists of a user input stroke, the actuator operating signal may be dependent on the detected user input stroke speed, user input stroke direction, and the user input stroke length.

Figure 11:
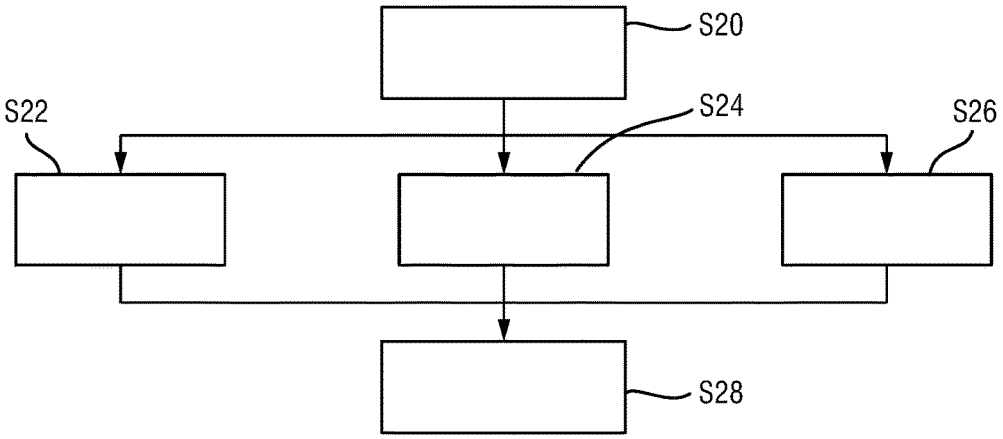
FIG. 11 shows yet another illustrative block diagram representing several sub-steps of an embodiment of the method illustrated in FIG. 10.

FIG. 11 illustrates several sub-steps of an embodiment of a method of operating an adjustable spacing comb in accordance with the present disclosure. Particularly, the detection of input in from of strokes across the sensitive surface of the sensor element is addressed. A step S20 may involve the detection of the stroke at the sensor element. Consequently, a multi-faceted user input signal may be detected by a control unit. The user input signal may comprise information as to several aspects of the input stroke.

The user input signal may be analysed and processed accordingly. By way of example, the method may comprise optional sub-steps that may be implemented as optional steps or in combination. The sub-steps may comprise a step S22 that involves the derivation of an input stroke direction from the input signal. Consequently, it may be assessed whether the user wants to extract or retract the movable comb portion. The sub-steps may further comprise a step S24 that involves the derivation of an input stroke speed from the input signal. Consequently, it may be assessed whether the user wants to operate movable comb portion at high speed or low speed to bridge large or small adjustment distances. The sub-steps may further comprise a step S26 that involves the derivation of an input stroke length from the input signal. Consequently, conclusions as to the desired qualitative and/or quantitative length adjustment values can be drawn from the input stroke length. A subsequent step S28 may involve the generation of a output signal under consideration of data obtained at any of the (sub-)steps S22, S24 and S26. Based on the output signal, the adjustment drive and thus the adjustable spacing comb may be operated to set the desired cutting length.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art in practicing the claimed invention, from a study of the drawings, the disclosure, and the appended claims.

In the claims, the word "comprising" does not exclude other elements or steps, and the indefinite article "a" or "an" does not exclude a plurality. A single element or other unit may fulfill the functions of several items recited in the claims. The mere fact that certain measures are recited in mutually different dependent claims does not indicate that a combination of these measures cannot be used to advantage.

Any reference signs in the claims should not be construed as limiting the scope.

The invention claimed is:

1. A method for operating an adjustable spacing comb for a hair cutting appliance, the method comprising:

providing an adjustment drive comprising an actuator for actuating a movable comb portion of the adjustable spacing comb;

providing a proximity sensitive or touch sensitive sensor element;

detecting multi-faceted user inputs applied to the sensor element, the detected multi-faceted user inputs including user input speed of an input stroke by the user;

outputting a user input signal that is derived from the detected multi-faceted user inputs;

providing a control unit coupled to the actuator and to the sensor element for selecting an adjustment mode of a plurality of adjustment modes with different length adjustment increments, respectively, in response to the detected user input speed of the input stroke and converting the user input signal into an actuator operating signal corresponding to the selected adjustment mode;

setting an adjustment length value of the adjustable spacing comb based on the actuator operating signal; and operating the actuator using the actuator operating signal.

2. An adjustment drive for an adjustable spacing comb for a hair cutting appliance, the adjustment drive comprising:

an actuator configured for actuating a movable comb portion of the adjustable spacing comb with respect to a blade set of the hair cutting appliance;

a sensor element configured to detect multi-faceted user inputs applied to the sensor element by a user, the multi-faceted user inputs comprising detected user input speed of an input stroke by the user, and to output a user input signal that is derived from the detected multi-faceted user inputs, wherein the actuator is operated on the basis of the user input signal; and a control unit coupled to the actuator and to the sensor element, the control unit configured to select an adjustment mode from a plurality of adjustment modes in response to the detected user input speed of the input stroke to set corresponding length adjustment increments for moving the movable comb portion, and to convert the user input signal into an actuator operating signal in accordance with the selected adjustment mode.

3. The adjustment drive as claimed in claim 2, wherein the control unit is further configured to set an adjustment direction based on a detected user input direction.

4. The adjustment drive as claimed in claim 2, wherein the actuator is operated on the basis of a set length adjustment increment.

5. The adjustment drive as claimed in in claim 2, wherein the control unit is further configured to convert a slow user input motion into a fine adjustment mode with a small length adjustment increment, and wherein the control unit is further configured to convert a fast user input motion into a rough adjustment mode with a large length adjustment increment.

6. The adjustment drive as claimed in claim 2, wherein the sensor element comprises a touch sensitive sensor element configured to detect touch gestures.

7. The adjustment drive as claimed in claim 2, wherein the sensor element comprises a touch sensitive surface including at least one tactile sensor.

8. The adjustment drive as claimed in claim 2, wherein the sensor element is a capacitive sensing element or a conductance sensing element.

9. The adjustment drive as claimed in claim 2, further comprising a feedback unit that is operably coupled to the control unit, wherein the control unit is further configured to provide user guidance indicating that user inputs are enabled at the sensor element, and to provide user feedback in response to the detected multi-faceted user inputs to the user.

10. The adjustment drive as claimed in claim 9, wherein the feedback unit further comprises at least one of an optical feedback element, an acoustic feedback element and a tactile feedback element.

11. The adjustment drive as claimed in claim 9, wherein the feedback unit comprises an array of optical feedback elements selectively operable to indicate a direction of potential user inputs.

12. The adjustment drive as claimed in claim 1, wherein the user input signal is indicative of at least one additional signal component selected from the group consisting of input direction, input drag length, and input path length.

13. The adjustment drive as claimed in claim 1, wherein the sensor element comprises a proximity sensitive sensor element configured to detect gestures in a proximity of the sensor element.

14. The adjustment drive as claimed in claim 1, wherein the in the detected user input speed is detected by detecting peak velocities or average velocities of the user input stroke.

15. The adjustment drive as claimed in claim 1, wherein the in the detected user input speed is detected based on a time interval actually required for accomplishing at least a portion of the user input stroke.

16. A hair cutting appliance, comprising:

a housing portion;

a cutting unit including a blade set;

an adjustable spacing comb comprising a movable comb portion configured to be moved with respect to the housing portion; and an adjustment drive comprising:

an actuator configured for actuating the movable comb portion with respect to the blade set;

a sensor element configured to detect at least a user input speed of an input stroke applied to the sensor element by a user and to output a user input signal that is derived, at least in part, the detected user input speed; and a control unit coupled to the actuator and to the sensor element, the control unit configured to select one of a plurality of adjustment modes with different length adjustment increments, respectively, for moving the movable comb portion in response to the detected user input speed of the input stroke and to convert the user input signal into an actuator operating signal for controlling the actuating of the moveable comb portion according to the selected adjustment mode.

* * * * *